US008070276B2

(12) United States Patent
Amma

(10) Patent No.: US 8,070,276 B2
(45) Date of Patent: Dec. 6, 2011

(54) INK JET RECORDING CARTRIDGE

(75) Inventor: Hiromasa Amma, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 547 days.

(21) Appl. No.: 12/244,661

(22) Filed: Oct. 2, 2008

(65) Prior Publication Data

US 2009/0091608 A1 Apr. 9, 2009

(30) Foreign Application Priority Data

Oct. 9, 2007 (JP) ..... 2007-263171

(51) Int. Cl.
*B41J 2/175* (2006.01)

(52) U.S. Cl. ..... 347/87; 347/84; 347/85; 347/86; 347/88; 347/89; 347/90; 347/91; 347/92; 347/93; 347/94

(58) Field of Classification Search ..... 347/84–94
See application file for complete search history.

(56) References Cited

U.S. PATENT DOCUMENTS

| | | | | |
|---|---|---|---|---|
| 5,453,771 | A | 9/1995 | Waseda et al. | 347/86 |
| 5,502,479 | A * | 3/1996 | Ishinaga et al. | 347/93 |
| 6,015,210 | A * | 1/2000 | Kanematsu et al. | 347/87 |
| 7,111,931 | B2 | 9/2006 | Amma et al. | 347/86 |
| 7,350,910 | B2 | 4/2008 | Amma et al. | 347/86 |
| 7,384,116 | B2 | 6/2008 | Kotaki et al. | 347/19 |
| 7,445,322 | B2 * | 11/2008 | Kitabatake et al. | 347/86 |
| 2005/0140761 | A1 * | 6/2005 | Amma et al. | 347/86 |
| 2008/0151023 | A1 | 6/2008 | Kotaki et al. | 347/86 |
| 2008/0211892 | A1 | 9/2008 | Kotaki et al. | 347/86 |

FOREIGN PATENT DOCUMENTS

| | | |
|---|---|---|
| JP | 6-15839 | 1/1994 |
| JP | 9-220814 | 8/1997 |

* cited by examiner

*Primary Examiner* — Ryan Lepisto
*Assistant Examiner* — Guy Anderson
(74) *Attorney, Agent, or Firm* — Fitzpatrick, Cella, Harper & Scinto

(57) ABSTRACT

A cartridge is constituted by a plurality of absorbing materials for retaining liquid, an interface formed by press-contact between opposing surfaces of the absorbing materials, an introducing portion for supplying the liquid out of the absorbing materials, and a filter provided at an end portion of the introducing portion. The absorbing materials press against the filter so that an end portion of the interface reaches the filter.

3 Claims, 10 Drawing Sheets

INK JET RECORDING CARTRIDGE

FIELD OF THE INVENTION AND RELATED ART

The present invention relates to an ink jet recording head for ejecting liquid such as ink to a recording medium thereby to effect recording and relates to an ink jet recording cartridge including a liquid reservoir portion for retaining the liquid to be supplied to the ink jet recording head.

A thermal type ink jet recording cartridge effects recording by causing film boiling of ink through application of driving energy to a heat generating resistor to eject ink droplets from an ink ejection outlet by a pressure generated by the film boiling.

Generally, the ink jet recording cartridge of this type includes ink ejection outlets for ejecting the ink, ink flow passages communicating with these ink ejection outlets, and heat generating resistors. The heat generating resistors are provided at positions corresponding to the ink ejection outlets in the ink flow passages.

The ink ejection outlets are arranged in lines to constitute arrays of ink ejection outlets. The respective ink flow passages communicate with associated ones of the ink ejection outlets communicate with a (single) common liquid (ink) chamber at a position opposite from a position at which the ink ejection outlets are formed. The common liquid chamber also communicates with an ink introducing passage provided in a container case including an ink reservoir portion for accommodating the ink. As a result, the ink is supplied from the ink reservoir portion to the ink flow passages through the ink introducing passage and the common liquid chamber.

At an end of an ink introducing portion forming the ink introducing passage, a filter for preventing supply of impurities to the ink ejection outlets is provided. The filter contacts an ink absorbing material contained in the ink reservoir portion and retains the ink.

The ink absorbing material is formed of a porous material or a fibrous material and retains the ink by a capillary force of the porous material or the fibrous material. When the ink at the ink ejection outlets is used (consumed) by ejection, the ink is introduced from the ink absorbing material to the ink ejection outlets by the ink flow passages and the ink ejection outlets which are higher in capillary force than the ink absorbing material. As a result, the ink ejection outlets are refilled with the ink.

In this case, it is ideal that all the ink in the ink absorbing material is used up. However, due to the capillary force of the ink absorbing material, residual interface in the ink absorbing material occurs. For this reason, it is difficult to use up all the ink in the ink absorbing material. Therefore, techniques for reducing the residual ink have been proposed.

Japanese Laid-Open Patent Application (JP-A) Hei 9-220814 describes an ink container using an ink absorbing material subjected to slit processing. In this ink container, the ink absorbing material is bent in a direction in which a slit portion is opened 180 degrees and accommodated in the ink container. The slit portion is bent to compress the ink absorbing material at an un-processing portion of slit, so that a high density portion is formed. This high density portion is located in the neighborhood of the ink ejection outlets.

The high density portion is high in capillary force, so that the ink in the ink absorbing material is collected at the high density portion. Therefore, the ink can be efficiently introduced into the ink ejection outlets to reduce the residual ink.

JP-A Hei 6-15839 describes an ink container using a plurality of ink absorbing materials different in density. In this ink container, the plurality of ink absorbing materials different in density is arranged toward an ink supply port in the order of a lower density ink absorbing material and a higher density ink absorbing material. Further, in order to prevent the ink from being interrupted by inclusion of air in a seam between the ink absorbing materials, the plurality of ink absorbing materials press-contacts each other to eliminate a gap of the seam between the ink absorbing materials.

In the ink container, the density is increased toward the ink supply port, so that the ink in the ink container is collected at the ink supply port. Therefore, it is possible to reduce residual ink.

In recent years, the ink jet recording head is improved in performances such as an image quality, a recording speed and the like. In order to improve the image quality, it is necessary to realize variety of species of ink to be supplied, minute ink droplets, and high-density arrangement of ink ejection outlets adapted to eject the minute ink droplets.

Further, in order to improve the recording speed of a recording apparatus in which a an ink jet recording cartridge is reciprocated for scanning on a recording medium to effect recording, due to an increase in number of ink ejection outlets adapted to eject ink droplets, it is necessary to increase a recording area during one scanning operation.

In the case of improving these performances, cost is increased frequently, so that cost reduction is also important factors together with the improvements in performances.

In the ink container described in JP-A Hei 9-220814, the residual ink can be reduced, so that a volume of the ink retained in the ink absorbing material in advance can be reduced, thus resulting in cost reduction. However, it is necessary to perform such a production step in which the ink absorbing material is subjected to the slit processing and is bent and inserted into the ink container. For this reason, there is a possibility of an increase in cost due to a complicated production process. Further, it is necessary to ensure an unprocessing portion of slit with precision, so that the ink absorbing material may be deceased in yield to result in a further increase in cost.

In the ink container described in JP-A Hei 6-15839, there is no possibility of the increase in cost due to the above-described complicated production process, so that it is possible to decrease the residual ink. However, the ink container is accompanied with the following problem.

The seam of the ink absorbing materials is press-contacted, so that the neighborhood of the press-contact portion is compressed. As a result, in the neighborhood of the press-contact portion, a density is higher than those at other portions to result in a high capillary force. For this reason, there is a possibility that the ink remains in the neighborhood of the high capillary force portion, i.e., the press-contact portion.

SUMMARY OF THE INVENTION

A principal object of the present invention is, in view of the above-described problem, to provide an ink jet recording cartridge capable of decreasing residual ink.

According to an aspect of the present invention, there is provided an ink jet recording head comprising:

an ink jet recording head;

a plurality of absorbing materials for retaining liquid;

an interface formed by press-contact between opposing surfaces of the absorbing materials;

an introducing portion for supplying the liquid from the absorbing materials to the ink jet recording head; and a filter provided at an end portion of the introducing portion, wherein the absorbing materials press against the filter so that an end portion of the interface contacts the filter.

According to the present invention, it is possible to decrease the residual ink while suppressing an increase in cost.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
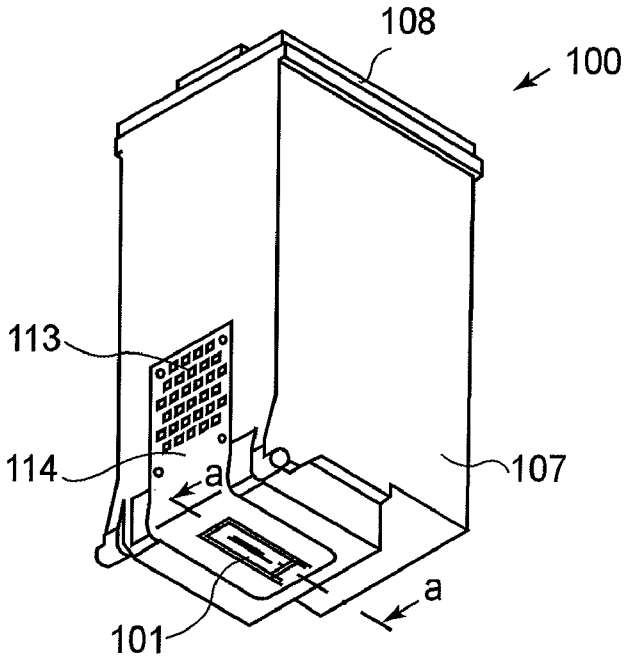
FIG. 1 is a perspective view of an ink jet recording cartridge of First Embodiment of the present invention.

Hereinbelow, embodiments of the present invention will be described with reference to the drawings.

In the following description, in the drawings, members or means having the same functions are represented by the same reference numerals or symbols and are omitted from redundant explanation in some cases.

Embodiment 1

FIG. 1 is a perspective view of an ink jet recording cartridge of First Embodiment of the present invention. Referring to FIG. 1, an ink jet recording cartridge 100 includes a container case 107 and a container cover 108.

To a bottom of the container case 107, an ink jet recording head 101 for ejecting liquid such as ink (hereinafter referred to as "ink") to effect recording is attached. Further, to a side surface of the container case 107, a contact portion 113 as electrical contact for receiving a driving signal or the like from an ink jet recording apparatus (not shown) is provided. The contact portion 113 and the ink jet recording head 101 are electrically connected by an electric wiring tape.

Figure 2:
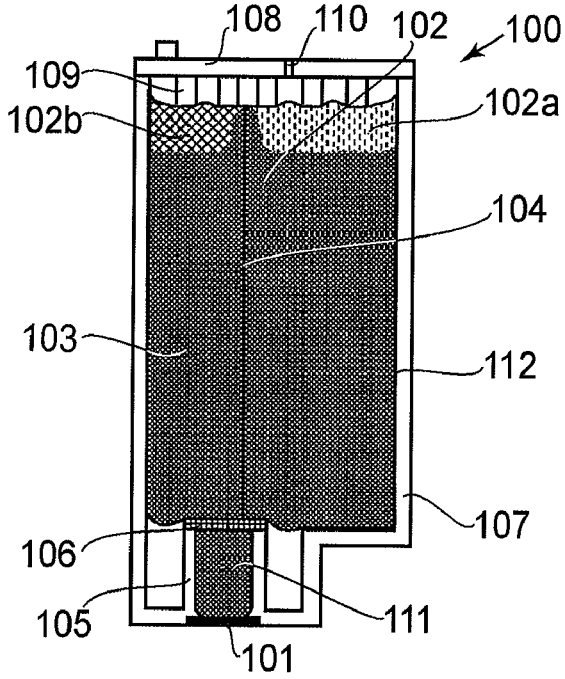
FIG. 2 is a sectional view of the ink jet recording cartridge of First Embodiment of the present invention.

FIG. 2 is a sectional view of the ink jet recording cartridge 100 taken along a-a line of FIG. 1.

As shown in FIG. 2, the ink jet recording cartridge 100 includes an ink reservoir portion 112, containing an ink absorbing material 102, formed by the container case 107 and the container cover 108.

The ink absorbing material 102 absorbs ink 103. An interface 104 is formed by press-contact between a plurality of opposing surfaces of the ink absorbing material 102. The ink absorbing material 102 is a fibrous absorbing material formed of polypropylene fibers.

At a bottom portion of the container case 107, an ink introducing portion 105 is provided so that it projects from a portion immediately on the ink jet recording head 101 to the ink reservoir portion 112. The ink introducing portion 105 is an introducing portion which forms an ink introducing passage 111 for establishing communication between the ink reservoir portion 112 and the ink jet recording head 101 through the ink introducing passage 111.

At an end of the ink introducing portion 105 projecting toward the ink reservoir portion 112, a filter 106 for preventing supply of impurities to the ink jet recording head 101 is provided. In this embodiment, the filter 106 is formed of SUS (stainless steel).

The container case 107 is openable at an upper portion which is covered with the container cover 108. The upper surface of the container case 107 is opposite from the bottom of the container case 107 at which the ink introducing portion 105 is formed.

At a bottom of the container cover 108, ribs 109 for fixing the ink absorbing material 102 by press-contact are formed so as to project downwardly. The container cover 108 is provided with ambient air communication port 110 for establishing communication between the ink reservoir portion 112 and the ambient air.

Next, the ink absorbing material 102 will be described more specifically.

Figure 3:
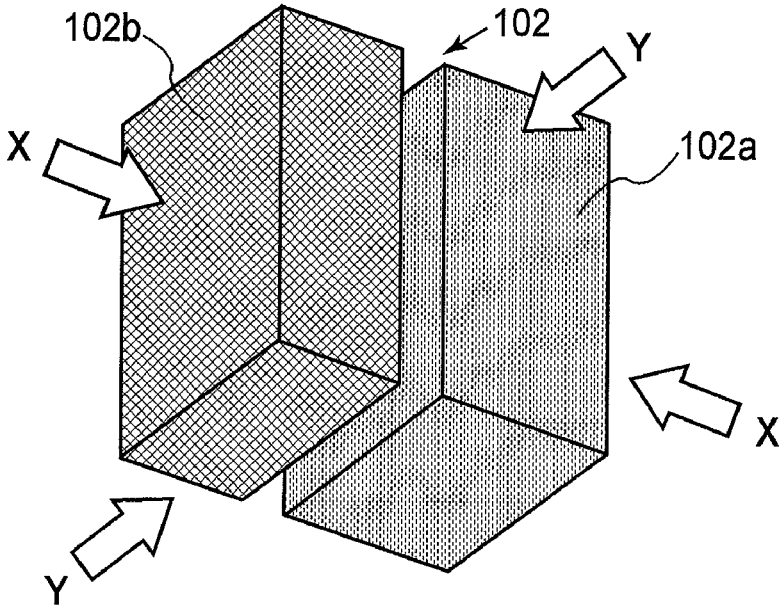
FIG. 3 is a perspective view of an ink absorbing material in the First Embodiment of the present invention.

FIG. 3 is a perspective view of the ink absorbing material 102 contained in the ink reservoir portion 112. In this embodiment, the ink absorbing material 102 is consisting of two ink absorbing materials 102*a* and 102*b*.

The ink absorbing materials 102*a* and 102*b* are contained in the ink reservoir portion 112 in a compressed state in an arrow X direction so that opposing surfaces of the ink absorbing materials 102*a* and 102*b* press-contact each other. Further, the ink absorbing materials 102*a* and 102*b* are contained in the ink reservoir portion 112 also in the compressed state in an arrow Y direction. For this reason, the ink absorbing materials 102*a* and 102*b* are, as shown in FIG. 2, contained in such a state that the ink absorbing materials 102*a* and 102*b* hermetically contact an inner wall of the container case 107.

In this embodiment, the respective opposing surfaces of the ink absorbing materials 102*a* and 102*b* press-contact each other, so that the interface 104 is formed at a press-contact portion between the ink absorbing materials 102*a* and 102*b*. Accordingly, in the neighborhood of the interface 104, a compression ratio is higher than those of other portions of the ink absorbing materials 102*a* and 102*b*, so that a capillary force is increased.

Further, as shown in FIG. 2, the ink absorbing materials 102*a* and 102*b* are pressed and fixed by the ribs 109 of the container cover 108. At this time, the ink absorbing materials 102*a* and 102*b* press-contact the filter 106 and fixed so that the interface 104 contacts the filter 106. Therefore, in the neighborhood of the press-contact portion between the ink absorbing materials 102*a* and 102*b* and the filter 106, the compression ratio is higher than those of other portions of the ink absorbing materials 102*a* and 102*b*, so that the capillary force is increased.

Next, a state of the ink used in the ink jet recording cartridge 100 will be described.

Figure 4:
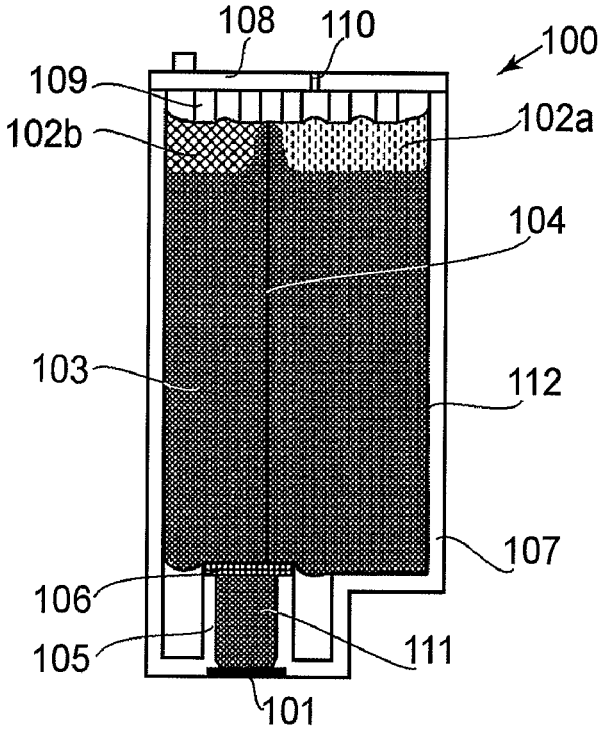
FIG. 4 is a sectional view showing a state of the ink jet recording cartridge of First Embodiment of the present invention before ink is not used.
Figure 5:
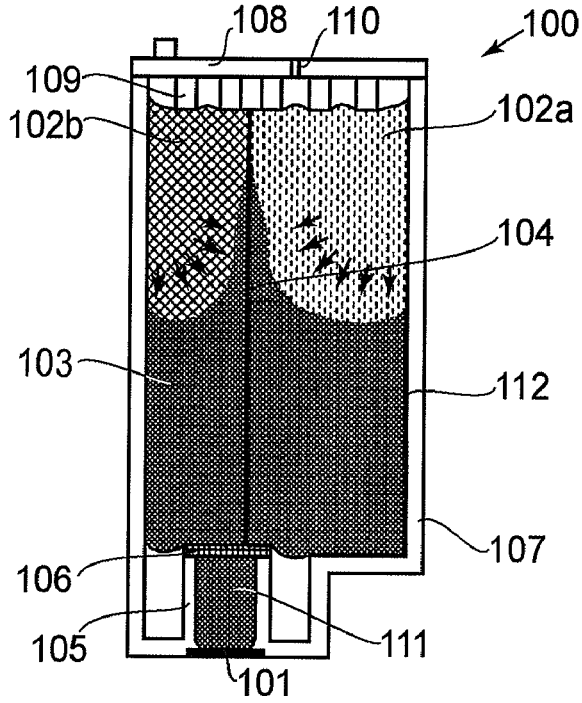
FIGS. 5 and 6 are sectional views each showing a state of partially used ink in the ink jet recording cartridge of First Embodiment of the present invention.
Figure 6:
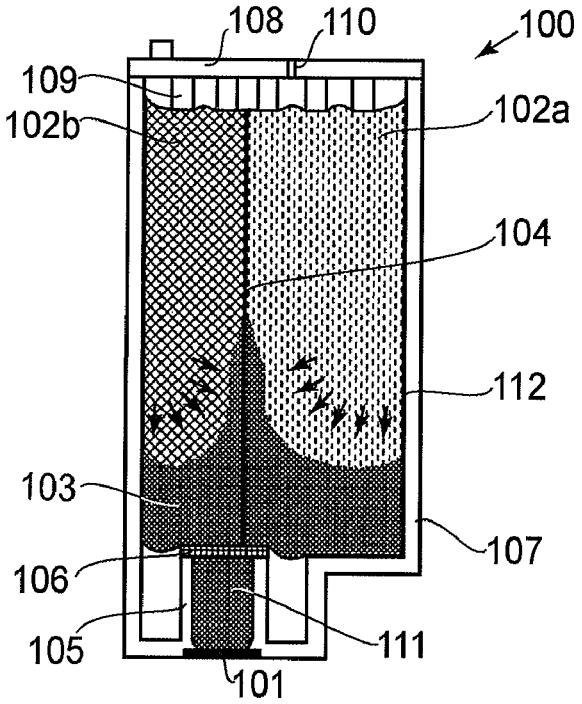

FIGS. 4 to 6 are schematic views for illustrating the state of the ink used in the ink jet recording cartridge 100 of this embodiment. Specifically, FIG. 4 is a sectional view of the ink jet recording cartridge 100 showing a state before the ink 103 is used (consumed). FIGS. 5 and 6 are sectional views of the ink jet recording cartridge 100 each showing a state of the partially used ink 103.

In the ink jet recording cartridge 100 shown in FIG. 4, when the ink 103 is used by ejection thereof by the ink jet recording head 101, the ink 103 is supplied to the ink jet recording head 101 through the ink introducing passage 111. During the supply, an inside pressure of the ink reservoir portion 112 is kept at a value equal to that of the ambient pressure by introducing the ambient air into the ink reservoir portion 112 through the ambient air communication port 110.

The ink 103 is liable to be retained at a portion, higher in capillary force, of the ink absorbing materials 102*a* and 102*b*. For this reason, as shown in FIGS. 5 and 6, the ink 103 is gradually consumed while being attracted to the neighborhood of the interface 104. This is because as described above, in the neighborhood of the interface 104, the compression ratio is higher than those of other portions of the ink absorbing materials 102*a* and 102*b*, thus resulting in a higher capillary force.

As a result, the ink 103 is collected in the neighborhood of the interface 104, so that the ink 103 remaining at other portions of the ink absorbing materials 102*a* and 102*b* can be reduced.

Further, the ink absorbing materials 102*a* and 102*b* press-contact the filter 106 as described above, so that the ink 103 retained in the neighborhood of the interface 104 is attracted to the neighborhood of the press-contact portion between the ink absorbing materials 102*a* and 102*b*, thus being supplied to the ink introducing passage 111 formed by the ink introducing portion 105.

According to this embodiment, the following effects can be achieved.

In this embodiment, the filter 106 is provided to the end of the ink introducing portion 105. The interface 104 is formed by press-contact between the opposing surfaces of the ink absorbing material 102. The ink absorbing material 102 press-contacts the filter 106 so that the interface 104 contacts the filter 106.

The interface 104 is formed by press-contact between the opposing surfaces of the ink absorbing material 102, so that in the neighborhood of the interface 104, the compression ratio is higher than those of other portions of the ink absorbing material 102 and the capillary force is increased. Therefore, the ink 103 is collected in the neighborhood of the interface 104, so that the ink 103 remaining at other portions of the ink absorbing material 102.

Further, the ink absorbing materials 102*a* and 102*b* press-contact the filter 106, so that the ink 103 retained in the neighborhood of the interface 104 is attracted to the neighborhood, of the press-contact portion between the ink absorbing materials 102*a* and the filter 106, higher in capillary force. As a result, the ink 103 is supplied to the ink introducing passage 111 formed by the ink introducing portion 105 through the filter 106.

Therefore, the residual ink can be reduced without using a complicated production process or a constitution, such as a bending step or the like. Thus, it is possible to reduce the residual ink while suppressing an increase in production cost.

Further, in this embodiment, the interface 104 is formed by press-contact between the opposing surfaces of the ink absorbing materials 102*a* and 102*b*. For this reason, the interface 104 can be formed easily.

Embodiment 2

Figure 7:
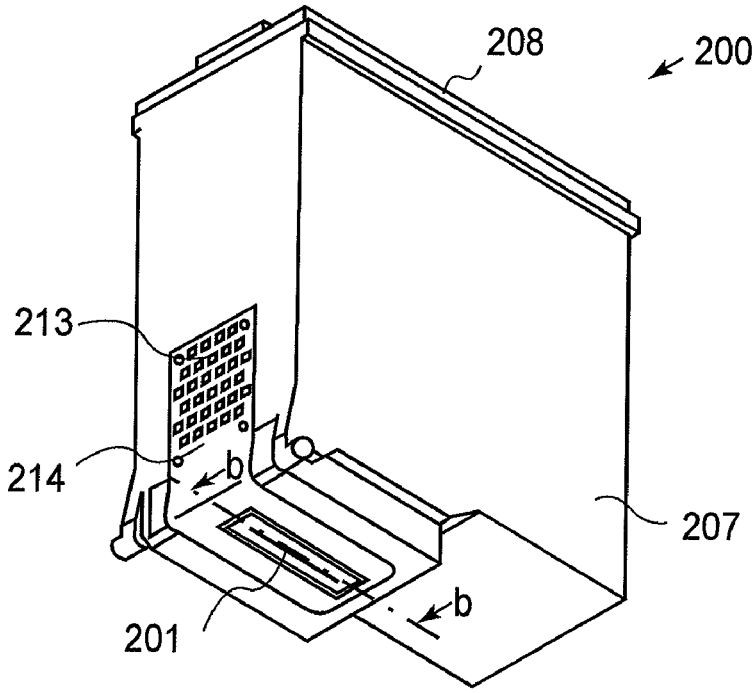
FIG. 7 is a perspective view of an ink jet recording cartridge of Second Embodiment of the present invention.

FIG. 7 is a perspective view of an ink jet recording cartridge of Second Embodiment of the present invention. Referring to FIG. 7, an ink jet recording cartridge 200 includes a container case 207 and a container cover 208.

To a bottom of the container case 207, an ink jet recording head 201 for ejecting ink to effect recording is attached. Further, to a side surface of the container case 207, a contact portion 213 as electrical contact for receiving a driving signal or the like from an ink jet recording apparatus (not shown) is provided. The contact portion 213 and the ink jet recording head 201 are electrically connected by an electric wiring tape.

Figure 8:
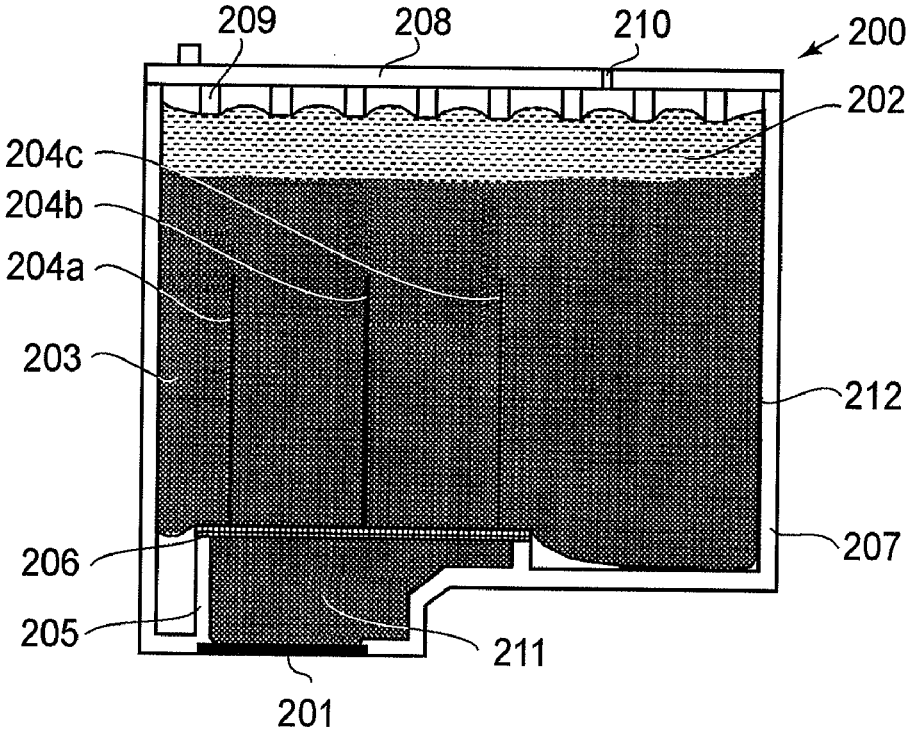
FIG. 8 is a sectional view of the ink jet recording cartridge of Second Embodiment of the present invention.

FIG. 8 is a sectional view of the ink jet recording cartridge 200 taken along b-b line of FIG. 7.

As shown in FIG. 8, the ink jet recording cartridge 200 includes an ink reservoir portion 212, containing an ink absorbing material 102, formed by the container case 207 and the container cover 208.

The ink absorbing material 102 absorbs ink 203. A plurality of inks 204*a* to 204*c* is formed by press-contact between a plurality of opposing surfaces of the ink absorbing material 102. The ink absorbing material 102 is a fibrous absorbing material formed of polypropylene fibers.

At a bottom portion of the container case 207, an ink introducing portion 205 is provided so that it projects from a portion immediately on the ink jet recording head 201 to the ink reservoir portion 212. The ink introducing portion 205 is an introducing portion which forms an ink introducing passage 211 for establishing communication between the ink reservoir portion 212 and the ink jet recording head 201 through the ink introducing passage 211.

At an end of the ink introducing portion 205 projecting toward the ink reservoir portion 212, a filter 206 for preventing supply of impurities to the ink jet recording head 201 is provided. In this embodiment, the filter 206 is formed of SUS.

The container case 207 is openable at an upper portion which is covered with the container cover 208. The upper surface of the container case 207 is opposite from the bottom of the container case 207 at which the ink introducing portion 205 is formed.

At a bottom of the container cover 208, ribs 209 for fixing the ink absorbing material 202 by press-contact are formed so as to project downwardly. The container cover 208 is provided with ambient air communication port 210 for establishing communication between the ink reservoir portion 212 and the ambient air.

Next, the ink absorbing material 202 will be described more specifically.

Figure 9:
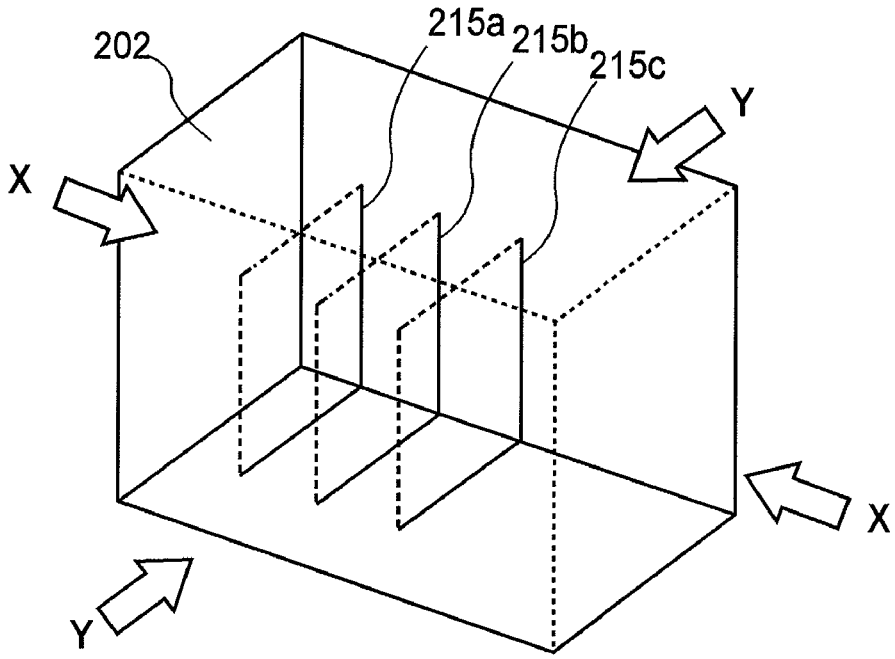
FIG. 9 is a perspective view of an ink absorbing material in the Second Embodiment of the present invention.

FIG. 9 is a perspective view of the ink absorbing material 202 contained in the ink reservoir portion 212. In this embodiment, the ink absorbing material 202 is provided with slits 215*a* to 215*c*.

The ink absorbing material 202 is contained in the ink reservoir portion 212 in a compressed state in an arrow X direction so that associated opposing surfaces of a plurality of surfaces of the ink absorbing material 102 press-contact each other through each of the slits 215*a* to 215*c*. Further, the ink absorbing material 102 is contained in the ink reservoir portion 212 also in the compressed state in an arrow Y direction. For this reason, the ink absorbing material 102 is, as shown in FIG. 8, contained in such a state that the ink absorbing material 102 hermetically contacts an inner wall of the container case 207.

In this embodiment, the respective opposing surfaces of the ink absorbing material 102 press-contact each other through each of the slits 215*a* to 215*c*, so that each of the interfaces 204*a* to 204*c* is formed at a press-contact portion of the ink absorbing material 102. Accordingly, in the neighborhood of each of the interfaces 204*a* to 204*c*, a compression ratio is higher than those of other portions of the ink absorbing material 102, so that a capillary force is increased.

Further, as shown in FIG. 8, the ink absorbing material 102 is pressed and fixed by the ribs 209 of the container cover 208. At this time, the ink absorbing material 102 press-contacts the filter 206 and fixed so that each of the interfaces 204*a* to 204*c* contacts the filter 206. Therefore, in the neighborhood of the press-contact portion between the ink absorbing material 102 and the filter 206, the compression ratio is higher than those of other portions of the ink absorbing material 102, so that the capillary force is increased.

Next, a state of the ink used in the ink jet recording cartridge 200 will be described.

Figure 10:
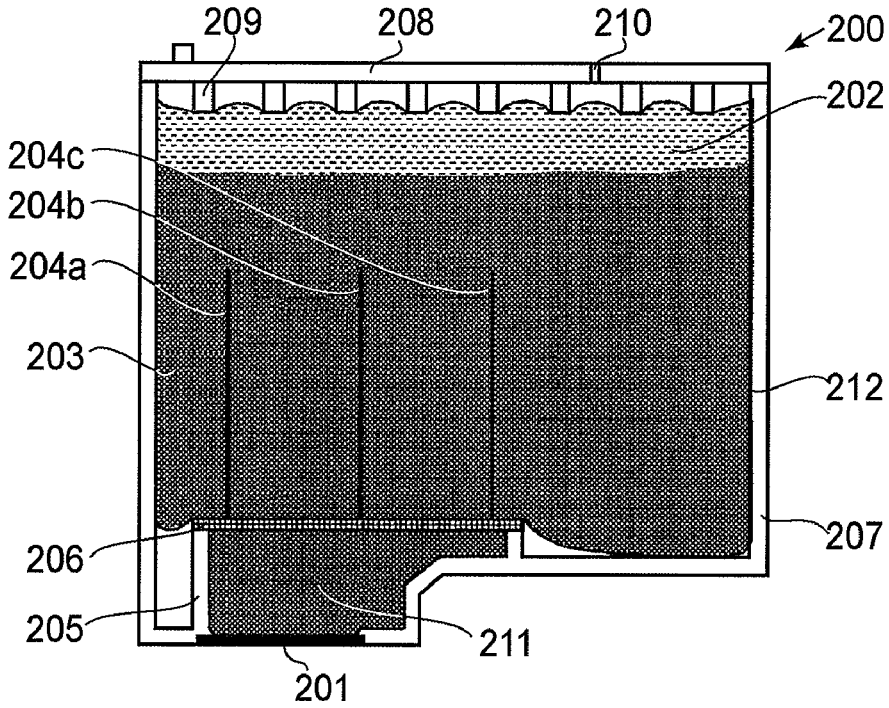
FIG. 10 is a sectional view showing a state of the ink jet recording cartridge of Second Embodiment of the present invention before ink is not used.
Figure 11:
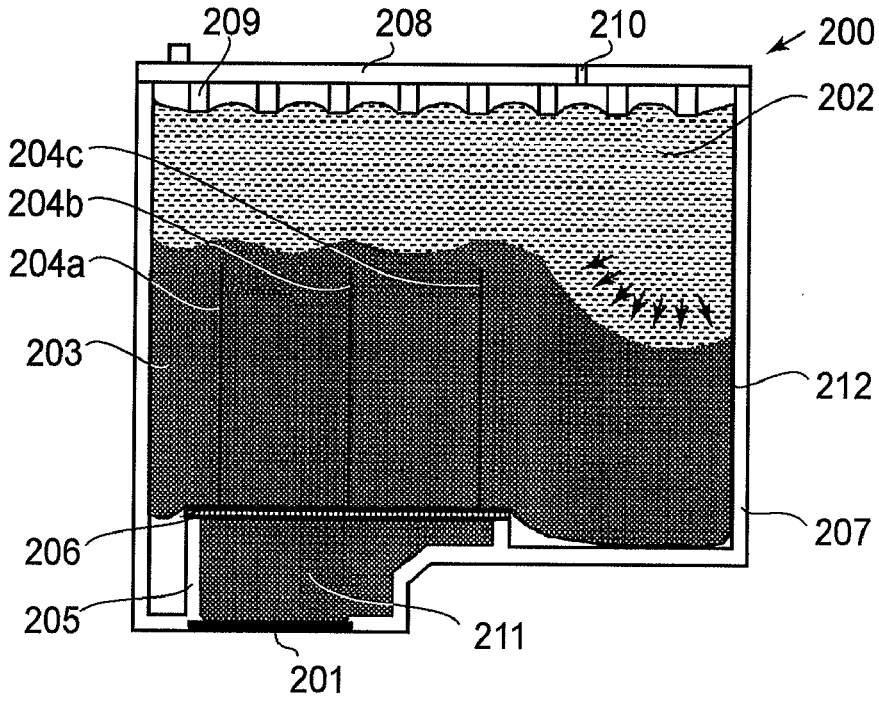
FIGS. 11, 12 and 13 are sectional views each showing a state of partially used ink in the ink jet recording cartridge of Second Embodiment of the present invention.
Figure 12:
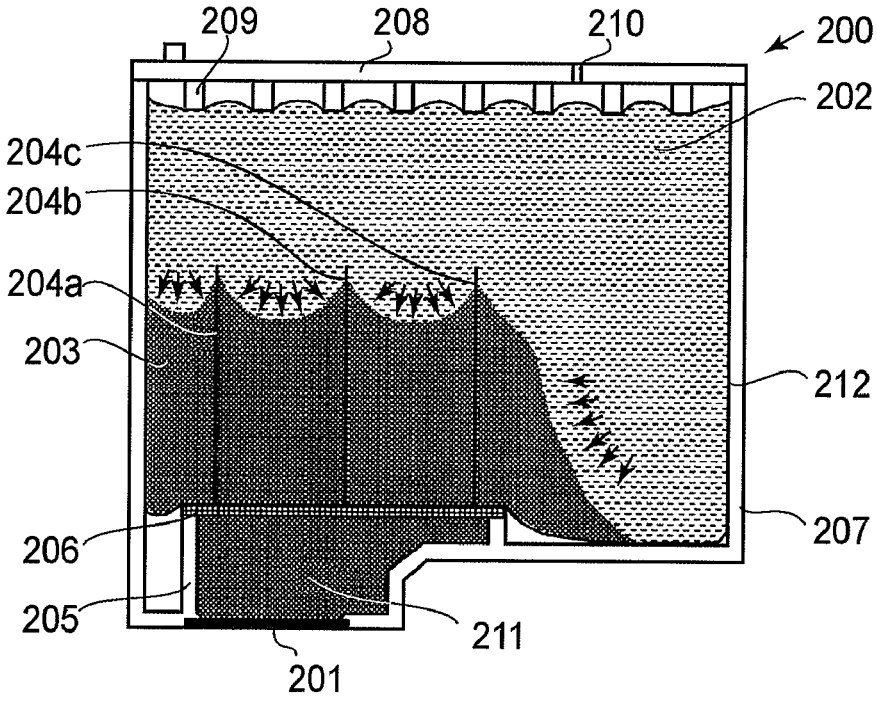
Figure 13:
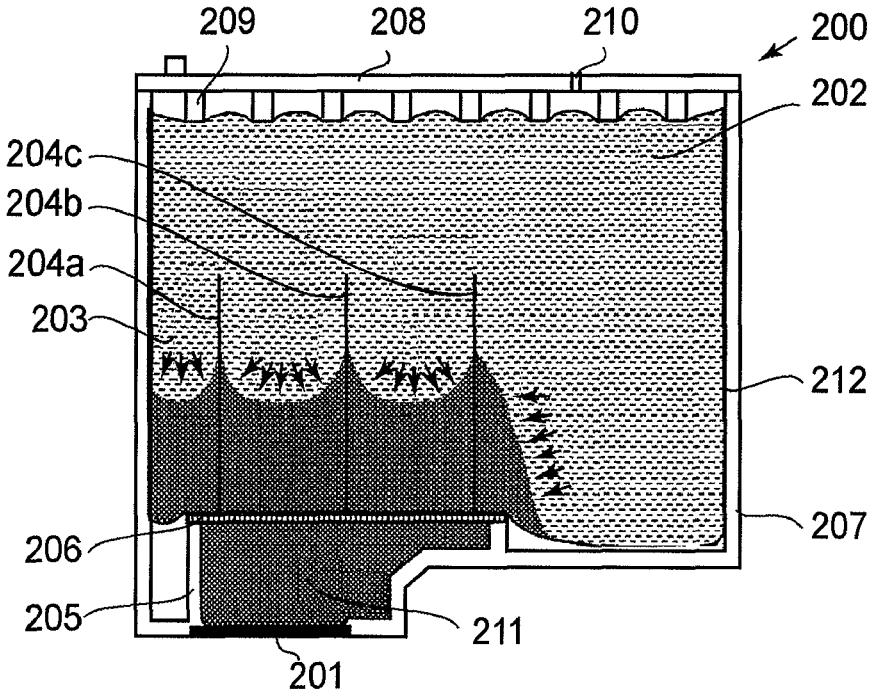

FIGS. 10 to 13 are schematic views for illustrating the state of the ink used in the ink jet recording cartridge 200 of this embodiment. Specifically, FIG. 10 is a sectional view of the ink jet recording cartridge 200 showing a state before the ink 203 is used (consumed). FIGS. 11 to 13 are sectional views of the ink jet recording cartridge 200 each showing a state of the partially used ink 203.

In the ink jet recording cartridge 200 shown in FIG. 10, when the ink 203 is used by ejection thereof by the ink jet recording head 201, the ink 203 is supplied to the ink jet recording head 201 through the ink introducing passage 211. During the supply, an inside pressure of the ink reservoir portion 212 is kept at a value equal to that of the ambient pressure by introducing the ambient air into the ink reservoir portion 212 through the ambient air communication port 210.

The ink 203 is liable to be retained at a portion, higher in capillary force, of the ink absorbing material 102. For this reason, as shown in FIGS. 11 to 13, the ink 203 is gradually consumed while being attracted to each of the neighborhood of each of the interfaces 204*a* to 204*c*. This is because as described above, in the neighborhood of each of the interfaces 204*a* to 204*c*, the compression ratio is higher than those of other portions of the ink absorbing material 102, thus resulting in a higher capillary force.

As a result, the ink 203 is collected in the neighborhood of each of the interfaces 204*a* to 204*c*, so that the ink 203 remaining at other portions of the ink absorbing material 102 can be reduced.

Further, each of the interfaces 204*a* to 204*c* contacts the filter 206 as described above, so that the ink 203 retained in the neighborhood of each of the interfaces 204*a* to 204*c* is supplied to the ink introducing passage 211.

According to this embodiment, the following effects can be achieved.

In this embodiment, each of the interfaces 204*a* to 204*c* contacts the filter 206. For this reason, particularly, when the filter 206 has a large size, it is possible to more efficiently supply the ink 203 retained in the ink absorbing material 202 to the ink jet recording head 201. Therefore, when the filter 206 has a large size, the residual ink can be decreased.

Further, in this embodiment, each of the interfaces 204*a* to 204*c* formed by press-contact between the opposing surfaces of the ink absorbing material 102 through each of the slits 215*a* to 215*c*. For this reason, each of the interfaces 204*a* to 204*c* can be formed easily.

Embodiment 3

Figure 14:
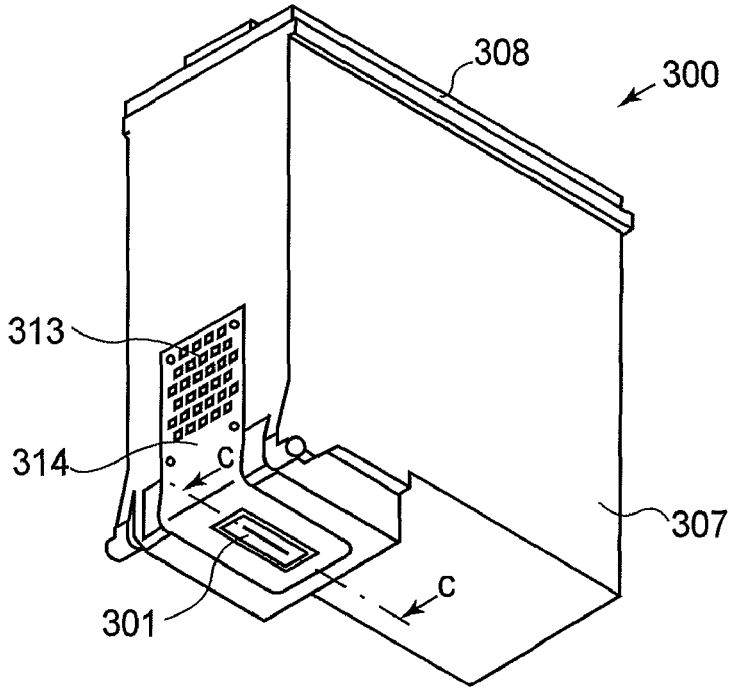
FIG. 14 is a perspective view of an ink jet recording cartridge of Third Embodiment of the present invention.

FIG. 14 is a perspective view of an ink jet recording cartridge of First Embodiment of the present invention. Referring to FIG. 14, an ink jet recording cartridge 300 includes a container case 307 and a container cover 308.

To a bottom of the container case 307, an ink jet recording head 301 for ejecting ink to effect recording is attached. Further, to a side surface of the container case 307, a contact portion 313 as electrical contact for receiving a driving signal or the like from an ink jet recording apparatus (not shown) is provided. The contact portion 313 and the ink jet recording head 301 are electrically connected by an electric wiring tape.

Figure 15:
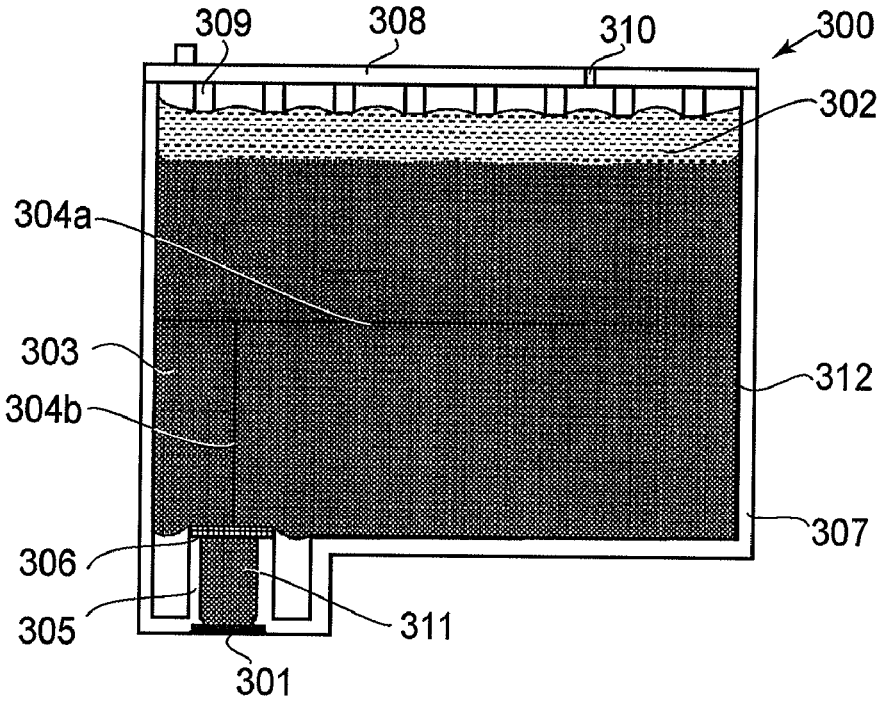
FIG. 15 is a sectional view of the ink jet recording cartridge of Third Embodiment of the present invention.

FIG. 15 is a sectional view of the ink jet recording cartridge 300 taken along c-c line of FIG. 14.

As shown in FIG. 15, the ink jet recording cartridge 300 includes an ink reservoir portion 312, containing an ink absorbing material 302, formed by the container case 307 and the container cover 308.

The ink absorbing material 302 absorbs ink 303. Each of interfaces 304*a* and 204*b* is formed by press-contact between a plurality of opposing surfaces of the ink absorbing material 302. The ink absorbing material 302 is a fibrous absorbing material formed of polypropylene fibers.

At a bottom portion of the container case 307, an ink introducing portion 305 is provided so that it projects from a portion immediately on the ink jet recording head 301 to the ink reservoir portion 312. The ink introducing portion 305 forms an ink introducing passage 311 for establishing communication between the ink reservoir portion 312 and the ink jet recording head 301 through the ink introducing passage 311.

At an end of the ink introducing portion 305 projecting toward the ink reservoir portion 312, a filter 306 for preventing supply of impurities to the ink jet recording head 301 is provided. In this embodiment, the filter 306 is formed of SUS.

The container case 307 is openable at an upper portion which is covered with the container cover 308. The upper surface of the container case 307 is opposite from the bottom of the container case 307 at which the ink introducing portion 305 is formed.

At a bottom of the container cover 308, ribs 309 for fixing the ink absorbing material 302 by press-contact are formed so as to project downwardly. The container cover 308 is provided with ambient air communication port 310 for establishing communication between the ink reservoir portion 312 and the ambient air.

Next, the ink absorbing material 302 will be described more specifically.

Figure 16:
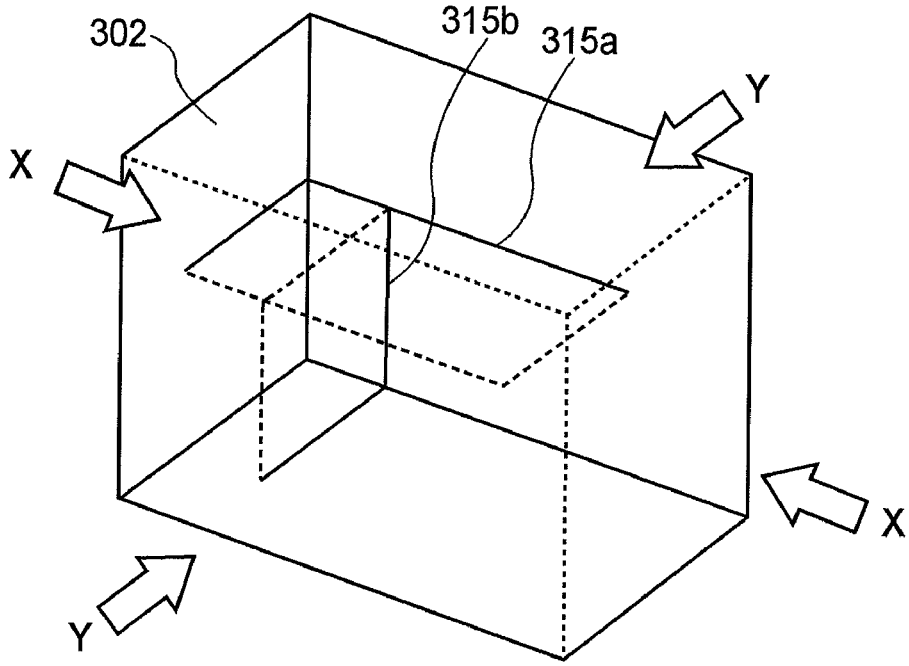
FIG. 16 is a perspective view of an ink absorbing material in the Third Embodiment of the present invention.

FIG. 16 is a perspective view of the ink absorbing material 302 contained in the ink reservoir portion 312. In this embodiment, the ink absorbing material 302 is provided with slits 315*a* and 315*b* extending perpendicular to each other.

The ink absorbing material 302 is contained in the ink reservoir portion 312 in a compressed state in an arrow X direction so that associated opposing surfaces of the ink absorbing material 302 press-contact each other through each of the slits 315*a* and 315*b*. Further, the ink absorbing material 302 is contained in the ink reservoir portion 312 also in the compressed state in an arrow Y direction. For this reason, the ink absorbing material 302 is, as shown in FIG. 16, contained in such a state that the ink absorbing material 302 hermetically contacts an inner wall of the container case 307.

In this embodiment, the opposing surfaces of the ink absorbing material 302 through the slit 315*b* press-contact each other, so that the interface 304*b* is formed at a press-contact portion of the ink absorbing material 302.

Further, as shown in FIG. 15, the ink absorbing material 302 is pressed and fixed by the ribs 309 of the container cover 308. At this time, the ink absorbing material 302 press-contact the filter 306 and fixed so that the interface 304*b* contacts the filter 306. Therefore, in the neighborhood of the press-contact portion between the ink absorbing material 302 and the filter 306, the compression ratio is higher than those of other portions of the ink absorbing material 302, so that the capillary force is increased.

Further, the opposing surfaces of the ink absorbing material 302 through the slit 315*a* press-contact each other, so that the interface 304*a* is formed at a press-contact portion of the ink absorbing material 304. As described above, the interface 304*b* is also formed at another press-contact portion of the ink absorbing material 304, so that in the neighborhood of each of the interfaces 304*a* and 204*b*, the compression ratio is higher than those of the other portions of the ink absorbing material 302, thus resulting in a higher capillary force.

Next, a state of the ink used in the ink jet recording cartridge 300 will be described.

Figure 17:
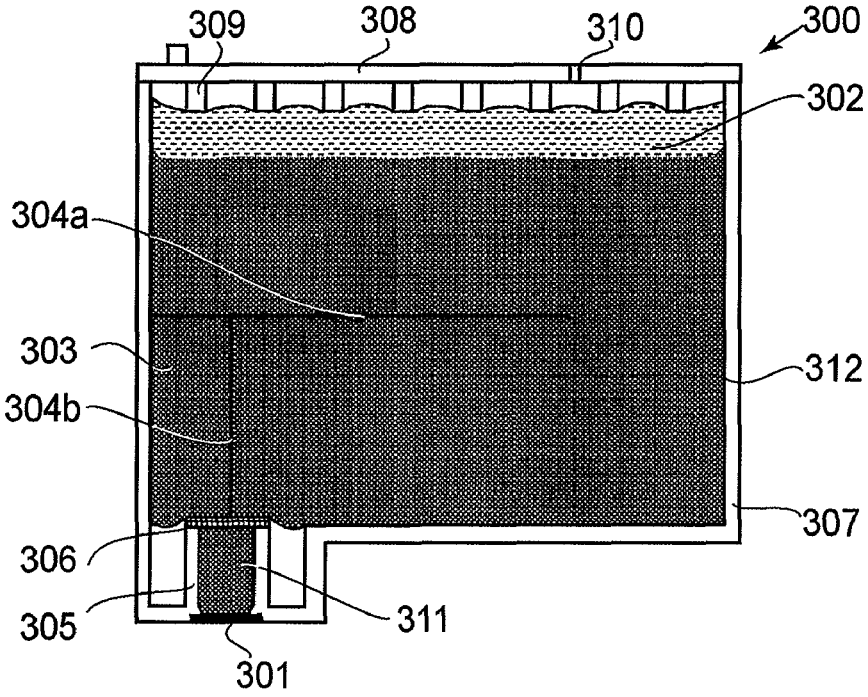
FIG. 17 is a sectional view showing a state of the ink jet recording cartridge of Third Embodiment of the present invention before ink is not used.
Figure 18:
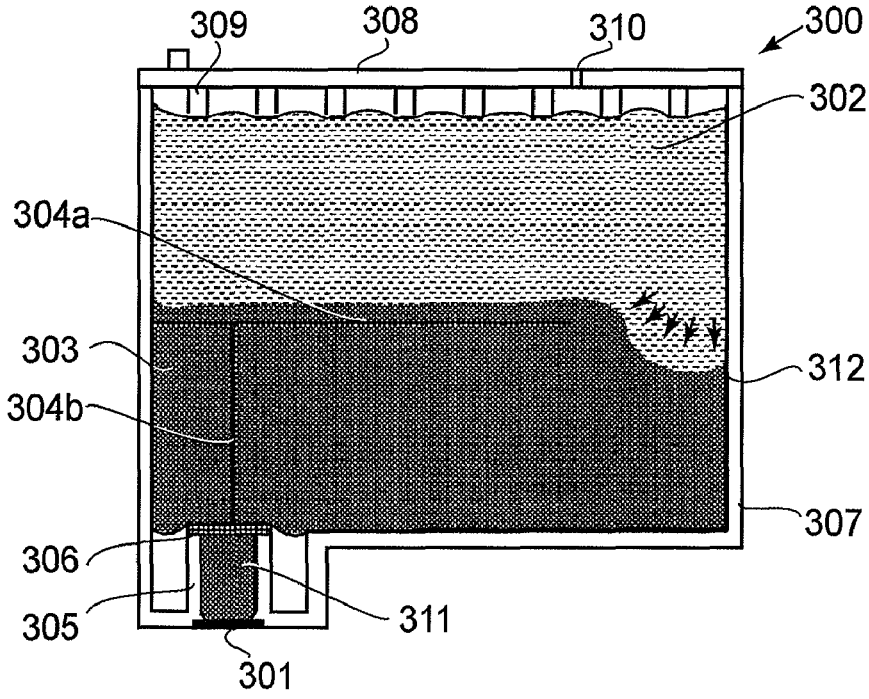
FIGS. 18, 19 and 20 are sectional views each showing a state of partially used ink in the ink jet recording cartridge of Third Embodiment of the present invention.
Figure 19:
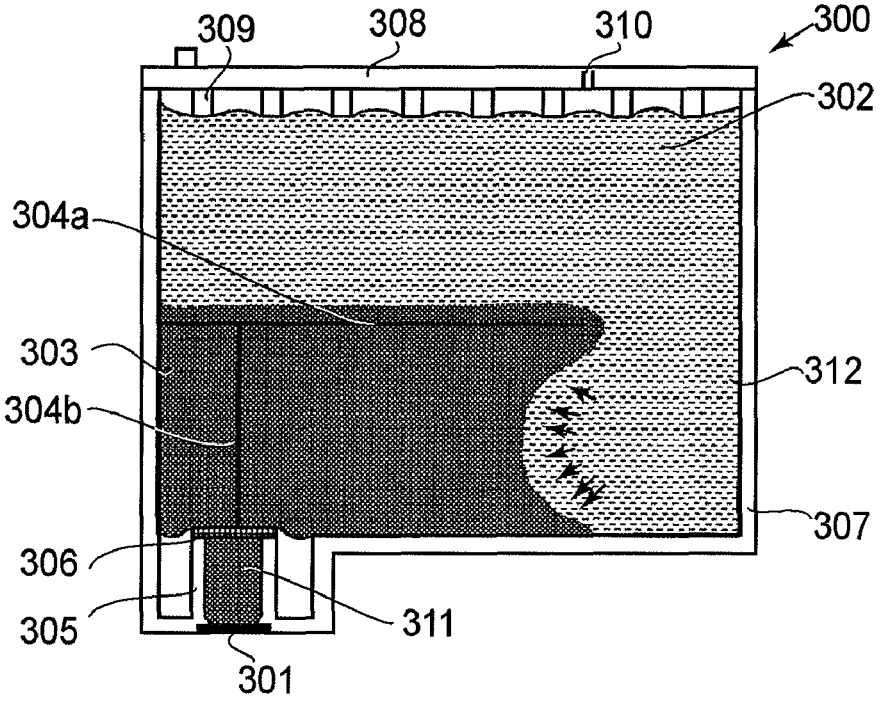
Figure 20:
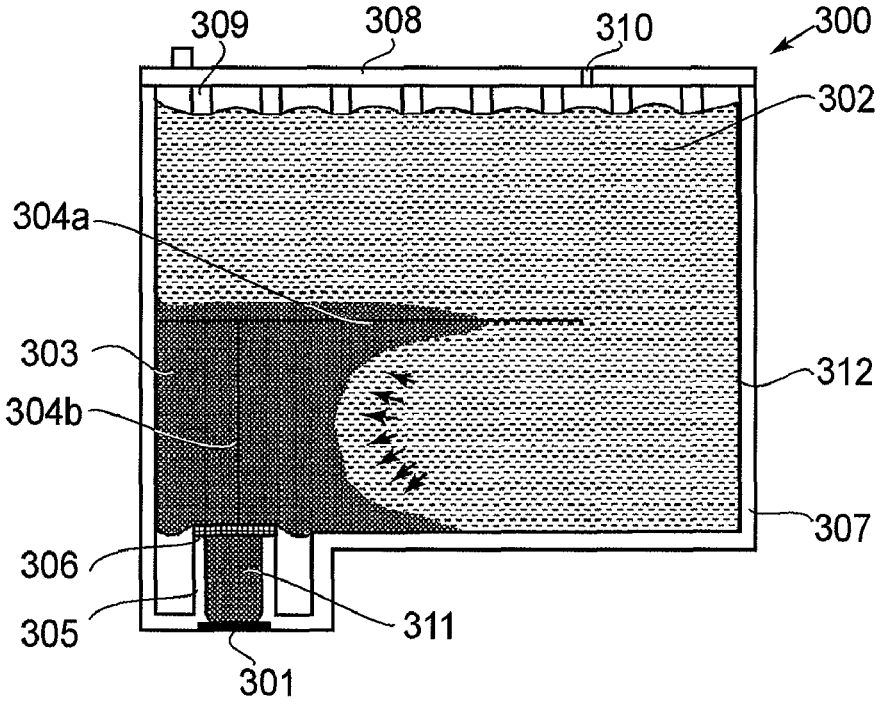

FIGS. 17 to 20 are schematic views for illustrating the state of the ink used in the ink jet recording cartridge 300 of this embodiment. Specifically, FIG. 17 is a sectional view of the ink jet recording cartridge 300 showing a state before the ink 303 is used (consumed). FIGS. 18 to 20 are sectional views of the ink jet recording cartridge 300 each showing a state of the partially used ink 303.

In the ink jet recording cartridge 300 shown in FIG. 17, when the ink 303 is used by ejection thereof by the ink jet recording head 301, the ink 303 is supplied to the ink jet recording head 301 through the ink introducing passage 311. During the supply, an inside pressure of the ink reservoir portion 312 is kept at a value equal to that of the ambient pressure by introducing the ambient air into the ink reservoir portion 312 through the ambient air communication port 310.

The ink 303 is liable to be retained at a portion, higher in capillary force, of the ink absorbing material 302. For this reason, as shown in FIGS. 11 to 13, the ink 303 is gradually consumed while being attracted to the neighborhood of the interface 304. This is because as described above, in the neighborhood of each of the interfaces 304*a* and 204*b*, the compression ratio is higher than those of other portions of the ink absorbing material 302, thus resulting in a higher capillary force.

As a result, the ink 303 is collected in the neighborhood of each of the interfaces 304*a* and 304*b*, so that the ink 303 remaining at other portions of the ink absorbing material 302 can be reduced.

The interface 304*a* is perpendicular to the interface 304*b* as described above and the interface 304*b* contacts the filter 306. For this reason, the ink 303 retained in the neighborhood of the interface 304*a* is attracted to the neighborhood of the interface 304*b* and is retained in the neighborhood of the interface 304*b*. Further, supplied to the ink introducing passage 311.

According to this embodiment, the following effects can be achieved.

In this embodiment, the interfaces 304*a* and 304*b* are perpendicular to each other. Further, the interface 304*b* contacts the filter 306. For this reason, particularly, when the ink reservoir portion 312 has a large size, i.e., when the ink absorbing material 302 is large, the ink 303 retained in the ink absorbing material 302 can be further efficiently supplied to the ink jet recording head 301. Therefore, particularly, when the ink absorbing material 302 is large in size, the residual ink can be decreased.

In the above-described embodiments, the illustrated constitutions are merely examples and the present invention is not limited to the constitutions.

For example, in First Embodiment, the number of the ink absorbing materials is two but may appropriately be changed to three or more. In the case where the number of the ink absorbing materials is more than two, the number of the interfaces 104 is two or more. In this case, each of the interfaces 104 may contact the filter 106 or each of the interfaces 104 is connected to another interface and at least one of the interfaces 104 may contact the filter 106.

In Second Embodiment, the number of the slits is three but can be appropriately changed. For example, in the case of a single slit, an interface formed by press-contact between both wall surfaces of the slit is only required to contact the filter 206. In the case where the number of slits is two or more, each of a plurality of interfaces formed by press-contact between associated both wall surfaces of the plurality of slits is only required to contact the filter 206.

In Third Embodiment, the number of the slits is two but can also be appropriately changed to three or more. In the case where the number of the slits is three or more, the number of interfaces is three or more. In this case, each of the interfaces is connected to another interface and at least one of the interfaces is only required to contact the filter 306.

The ink jet recording cartridge may also employ a plurality of ink absorbing materials at least one of which includes a slit. In this case, interfaces in the ink jet recording head include an interface formed by press-contact between opposing surfaces of the plurality of ink absorbing materials and an interface formed by press-contact between opposing surfaces through the slit in combination. Further, in the ink jet recording cartridge, the interface may also be formed by press-contact between opposing surfaces formed by bending a single ink absorbing material.

In First, Second and Third Embodiments, the ink absorbing materials 102, 202 and 302 are the fibrous absorbing material formed of the polypropylene fibers but can be appropriately changed. For example, the ink absorbing materials 102, 202 and 302 may also be a fibrous absorbing material formed of other fibers or an absorbing material formed of a porous member such as urethane form.

The filters 106, 206 and 306 in First, Second and Third Embodiments are formed of SUS but can also be changed appropriately. The filters 106, 206 and 306 may also be formed of, e.g., fibers or the like so long as they can prevent supply of impurities to the ink jet recording heads 101, 102 and 301.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 263171/2007 filed Oct. 9, 2007, which is hereby incorporated by reference.

What is claimed is:

1. A cartridge comprising:

a plurality of absorbing materials for retaining liquid;

an interface formed by press contact between opposing surfaces of said absorbing materials;

an introducing portion for supplying the liquid out of said absorbing materials; and a filter provided at an end portion of said introducing portion, wherein said absorbing materials press against said filter so that an end portion of said interface reaches said filter.

2. A cartridge according to claim 1, wherein said interface includes a plurality of interface portions which reach said filter.

3. A cartridge according to claim 1, wherein said interface includes a plurality of interface portions connected to each other, and wherein at least one of the interface portions reaches said filter.

* * * * *